US005217312A

United States Patent [19]

Ruhe et al.

[11] Patent Number: 5,217,312

[45] Date of Patent: Jun. 8, 1993

[54] SINGLE LEVER PUSH/PULL/PARK SELECTOR FOR PRINTER FORMS TRACTOR

[75] Inventors: Thomas W. Ruhe; David K. Schattner; John A. Schmidt, all of Lexington, Ky.

[73] Assignee: Lexmark International, Inc., Greenwich, Conn.

[21] Appl. No.: 885,598

[22] Filed: May 19, 1992

[51] Int. Cl.[5] ..... B41J 11/32; B41J 13/03

[52] U.S. Cl. ..... 400/616.1; 400/605; 400/636

[58] Field of Search ..... 400/605, 616, 616.1, 400/616.2, 616.3, 636; 226/74

[56] References Cited

U.S. PATENT DOCUMENTS

| | | | |
|---|---|---|---|
| 4,571,103 | 2/1986 | Takeo et al. | 400/616.2 |
| 4,742,946 | 5/1988 | Hamamichi et al. | 226/74 |
| 4,808,019 | 2/1989 | Olson et al. | 400/605 |
| 4,896,979 | 1/1990 | Nolte et al. | 400/605 |
| 4,898,488 | 2/1990 | Yokoi et al. | 400/642 |
| 4,913,574 | 4/1990 | Yokoi | 400/605 |
| 4,995,745 | 2/1991 | Yokoi et al. | 400/605 |
| 5,011,313 | 4/1991 | Sato | 400/605 |
| 5,026,184 | 6/1991 | Durr et al. | 400/605 |
| 5,030,024 | 7/1991 | Seshimo | 400/605 |

FOREIGN PATENT DOCUMENTS

| | | | |
|---|---|---|---|
| 52375 | 3/1985 | Japan | 400/616.1 |
| 51369 | 3/1986 | Japan | 400/616 |
| 84263 | 4/1986 | Japan | 400/616.2 |
| 120779 | 6/1986 | Japan | 400/605 |
| 302080 | 12/1988 | Japan | 400/616.1 |

OTHER PUBLICATIONS

"Operating Instructions KX-P1124 Impact Dot Matrix Printer", Panasonic Industrial Company, Computer Products Division.

*Primary Examiner*—Edgar S. Burr
*Assistant Examiner*—Stephen R. Funk
*Attorney, Agent, or Firm*—B. Franklin Griffin, Jr.

[57] ABSTRACT

A single manually operated mode selector lever controls selection of a push, pull or park mode of operation of a form feed tractor in a printer. The lever controls a cam which moves a spring-biased tractor drive shaft axially so that a gear on the drive shaft selectively engages a first gear which drives the shaft in a first direction, a second gear which drives the shaft in a second direction, or engages no gear so that the drive shaft is not driven. The form feed tractors are mounted on the drive shaft so that the shaft may move along its axis relative to the tractors or the tractors may be pivoted relative to the shaft. The mode selector lever also controls a mechanism which applies a force to a tractor plate so as to pivot the tractors about the drive shaft, thereby changing the orientation of the tractors relative to the platen. The force applied to the tractor plate is also transmitted to pressure or pinch rolls in the pull mode to relieve constraint on movement of the forms.

18 Claims, 5 Drawing Sheets

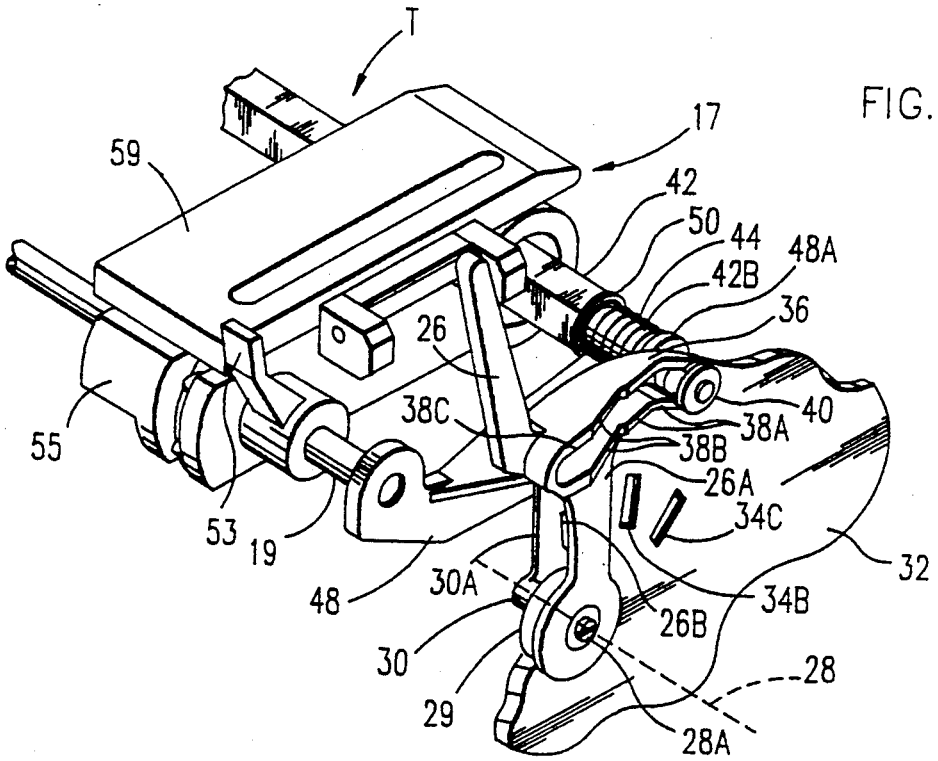
FIG. 2
FIG. 5
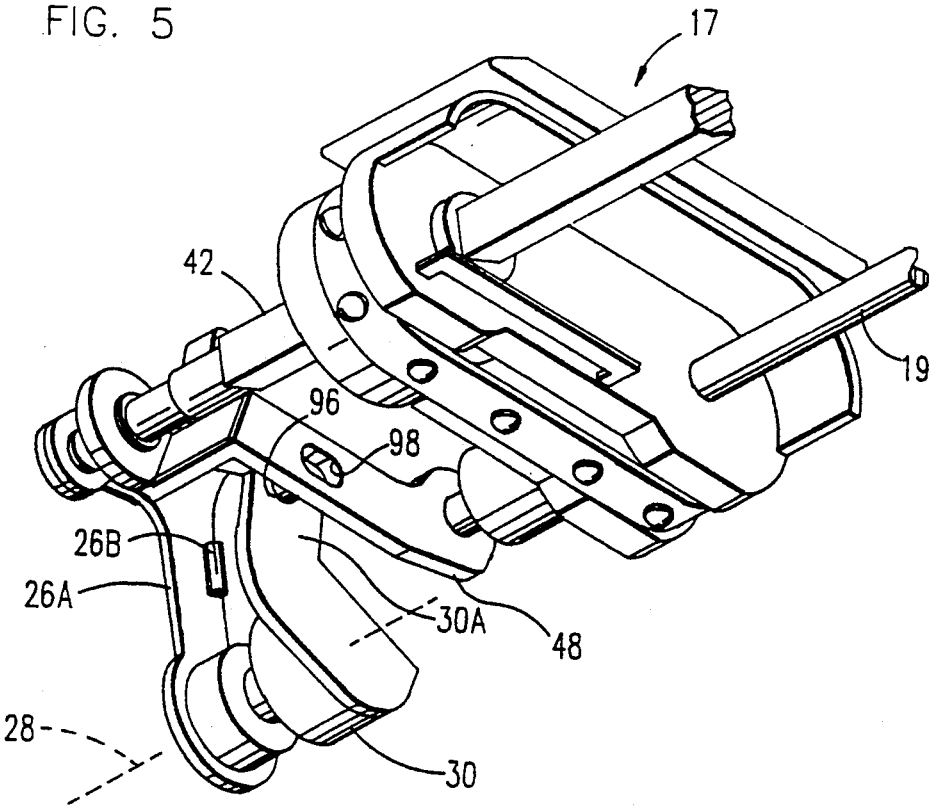

(PULL)

(PUSH)

(PARK)

SINGLE LEVER PUSH/PULL/PARK SELECTOR FOR PRINTER FORMS TRACTOR

FIELD OF THE INVENTION

The present invention relates to form feed tractors in printers, and more particularly to form feed tractors of the type operable in a push, a pull or a park mode.

BACKGROUND OF THE INVENTION

Form feed tractors operable in a push, a pull or a park mode are well known in the art. The publication Operating Instructions KX-P1124 Impact Dot Matrix Printer by Panasonic discloses a printer wherein a pair of tractors may be controlled so as to push continuous forms or fanfold paper toward a printing platen, pull the forms away from the printing platen, or park the tractors so that single sheets of paper may be fed into the printer. The device disclosed in the publication has a selector lever for selecting the mode of operation. However, in addition to operating the lever to select the mode, an operator must remove the top cover of the printer, pinch a pair of tractor position shift levers, and manually orient the tractors relative to the printing platen. This takes time, is inconvenient for the operator, and introduces a possible operating error in that the operator may not set the tractors to a position corresponding to that selected by the setting of the selector lever.

SUMMARY OF THE INVENTION

An object of the present invention is to provide a tractor form feed device responsive to the positioning of a single mode selector lever for setting both the orientation of the tractors relative to a printing platen and the direction of form feed by the tractors.

A further object of the invention is to provide a tractor form feed device wherein the tractor drive shaft is shiftable in its axial direction relative to the tractors and the tractors are mounted on the drive shaft so as to be rotatable on the drive shaft.

Another object of the invention is to provide a tractor form feed device wherein a single mode selector lever is movable between a push, a pull and a park position to selectively engage a drive mechanism with a tractor drive shaft to drive the drive shaft in a first or a second direction when the lever is in the push or the pull position, or disengage the drive mechanism from the drive shaft when the lever in the park position, the lever simultaneously rotating the tractors about the drive shaft to change the path over which forms are transported between the tractors and a platen.

In accordance with the principles of the present invention, a drive mechanism rotates two drive gears in opposite directions. A drive shaft for driving two form feed tractors is spring biased and axially movable. A single manually operated selector lever moves a cam which shifts the drive shaft axially between a push, a pull and a park position so that a gear on the drive shaft is selectively driven by one or the other, or neither, of the two drive gears. The form feed tractors are pivotally and slidably mounted at one end on the drive shaft and at the other end the tractors are slidably mounted on a tractor guide rod. A tractor plate is also pivotally mounted at one end for rotation about the drive shaft and attached at the other end to the guide rod. The selector lever drives a bell crank which applies force to the tractor plate so that the tractors are rotated relative to the drive shaft thereby orienting the tractors relative to a printing platen at the same time the drive shaft is shifted axially.

Other objects of the invention and its mode of operation will become apparent upon consideration of the following description and the accompanying drawings.

BRIEF DESCRIPTION OF THE DRAWINGS

FIG. 2 is a perspective view illustrating a mechanism responsive to movement of a single lever for shifting a tractor drive shaft axially and rotating a form feed tractor about the drive shaft;

FIG. 5 is a perspective view, taken from the rear and below the printer, illustrating the mechanism for pivoting the tractor assembly; and, FIGS. 6A, 6B and 6C are schematic diagrams illustrating the paths of paper movement for the pull, push and park modes, respectively.

DETAILED DESCRIPTION OF THE INVENTION

Figure 1:
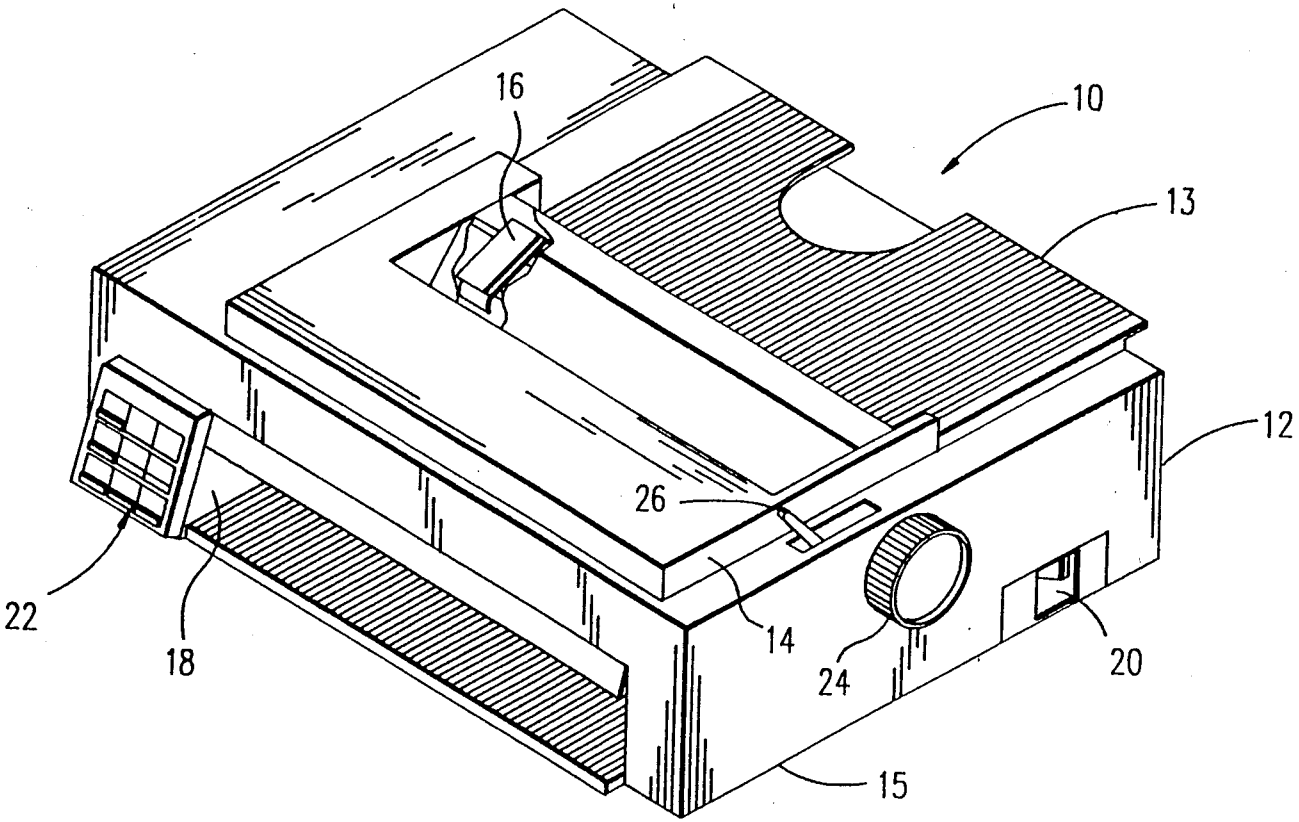
FIG. 1 is a right front perspective view of a printer in which the present invention may be utilized.

FIG. 1 is a right front perspective view of a printer 10 in which the present invention may be utilized. Printer 10 is enclosed within a housing 12 having top covers 13 and 14. The covers 13 and 14 are removable to permit access to two pin feed tractors which feed paper of the continuous form type. The covers 13 and 14 are shown partially broken away in FIG. 1 to reveal a left feed tractor 16. The housing 12 is provided with a front opening 18 through which single sheets of paper may be fed and a bottom opening, indicated at 15, through which continuous forms may be fed. An on/off switch 20 is provided at one side of the printer to control electrical power applied to the printer. A control panel 22 is provided with a plurality of push-buttons to control various printer functions, only one of which is relevant to the present invention as subsequently described. A control knob 24 is provided to enable an operator to manually feed paper to adjust its position. The printer 10 may, for example, be an IBM PROPRINTER TM 24 P, modified to provide the bottom opening 15. In accordance with the principles of the present invention, a single manually operable mode select lever 26 is provided to select one of three paper feeding modes: push, pull or park as subsequently described.

Figure 3:
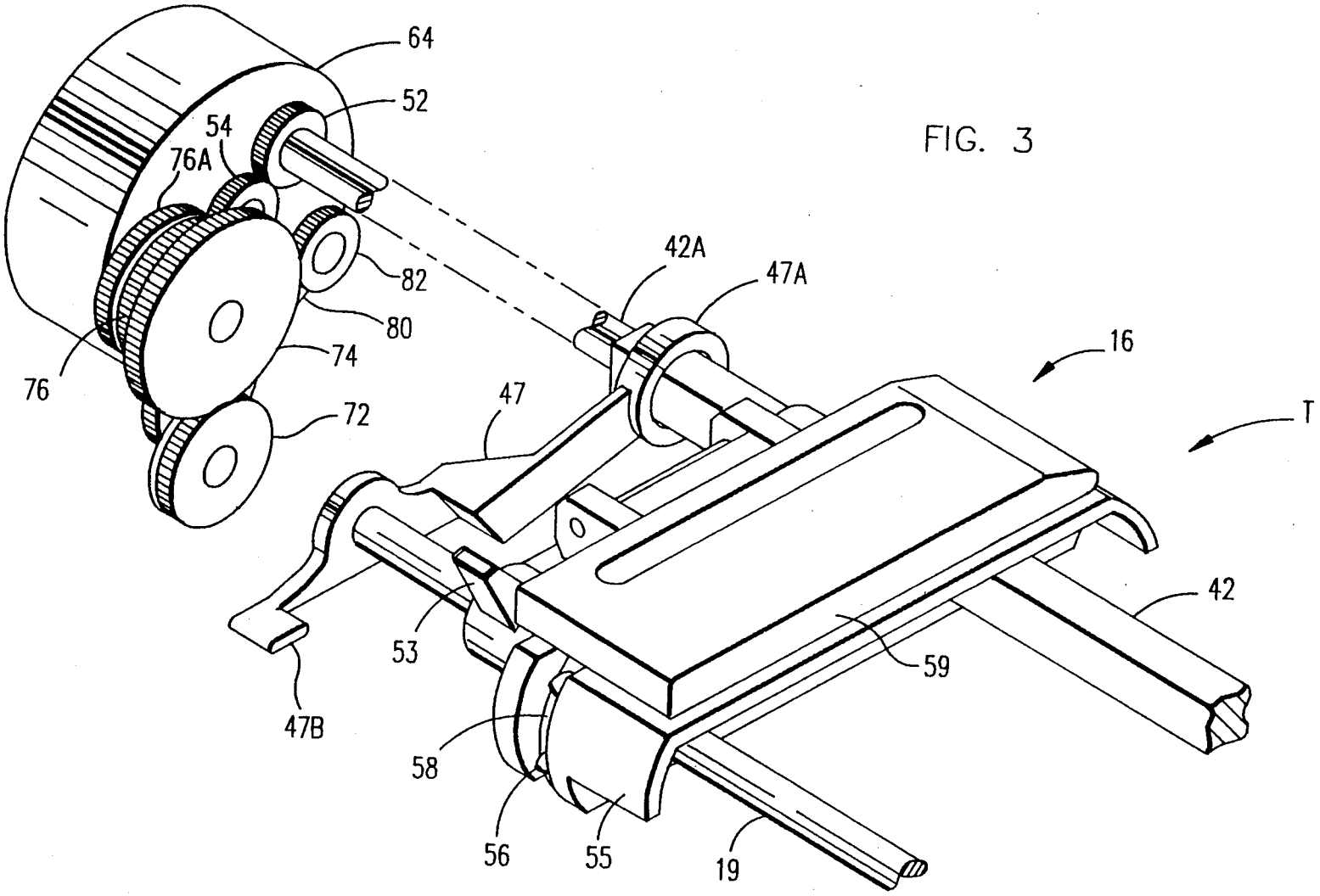
FIG. 3 is a perspective view of the left end of the tractor drive shaft showing the drive motor and left tractor.
Figure 4:
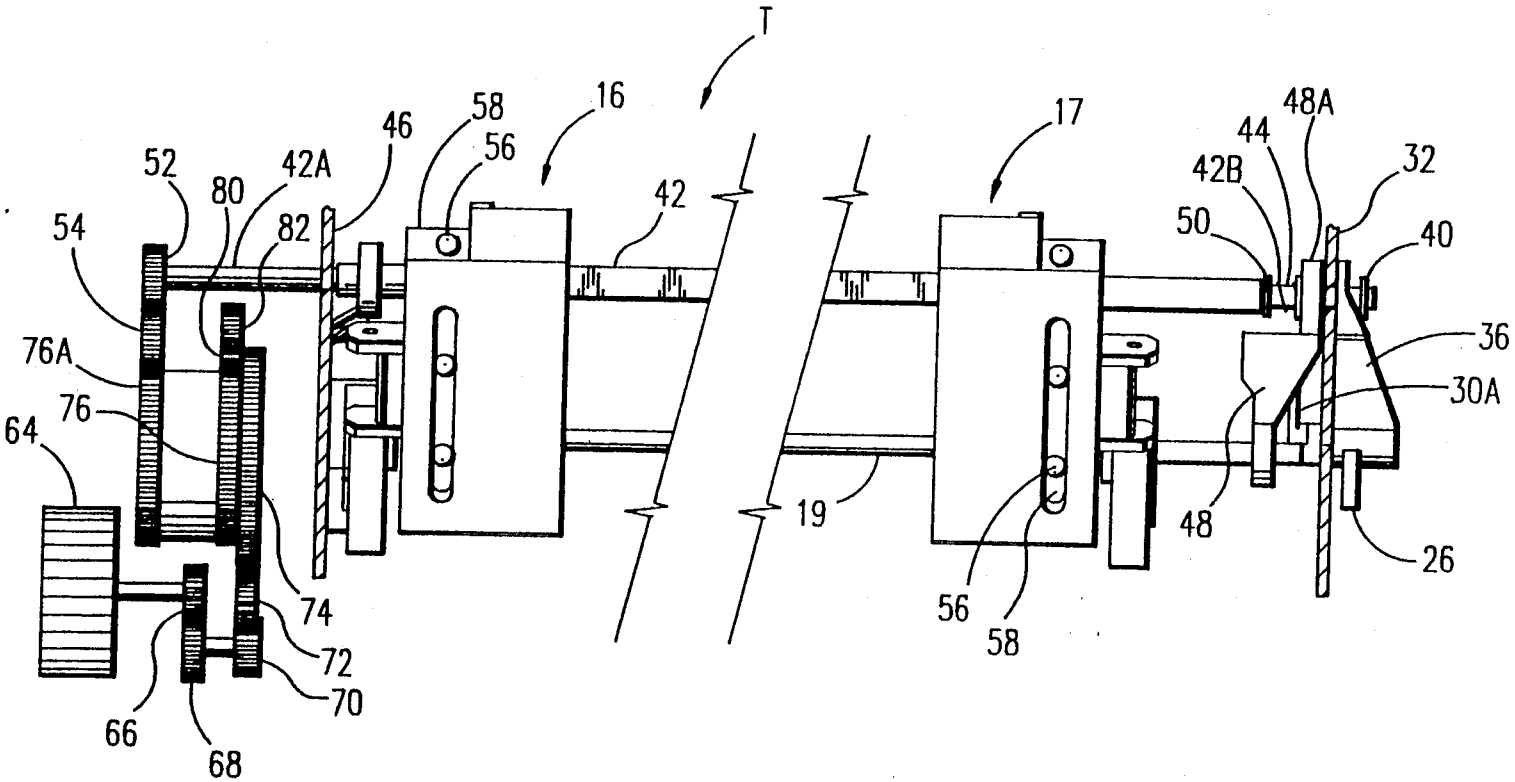
FIG. 4 is a front view of the tractor mechanism.

As shown in FIGS. 2–4, the printer is provided with a continuous form feed tractor assembly T including left and right tractors 16 and 17, a tractor guide rod 19, and left and right tractor plates 47 and 48. The tractors 16 and 17 are rotatably and slidably mounted at one end on a square portion of a drive shaft 42 and slidably mounted at the other end on the tractor guide rod 19. The tractor guide rod is supported at one end by the left tractor plate 47 and at the other end by the right tractor plate 48. The tractor plates have integrally formed support bearings 47A, 48A mounted for free rotation on the drive shaft 42. As subsequently explained, the mode selector lever 26 controls the position of the tractor assembly T, and by applying a force to the right tractor plate 48, may pivot the tractors 16 and 17 about the drive shaft 42 to orient the tractors in one of three positions relative to a printing platen 62, these orientations being illustrated in FIGS. 6A-6C.

The tractors 16 and 17 are of conventional design. Each tractor includes a paper support plate 55 slidably and pivotally mounted at one end on drive shaft 42 and slidably mounted at the other end on the guide rod 19. The tractors may slide along the guide rod and drive shaft so that they may be adjusted to accommodate forms of different widths. Manually operated levers 53 control internal cams (not shown) for locking the tractors in position. Each tractor has a drive sprocket (not shown) which is driven by the drive shaft 42. The sprocket has a square center hole so that it may slide relative to shaft 42 yet still be driven by the shaft. The sprocket drives a pin feed belt 58 having feed pins 56 formed thereon. Each tractor further includes a pressure plate 59 pivoted at one side so that it may be raised. A continuous form is mounted in the tractors in a conventional manner. That is, the top plates are raised, the tractors are positioned laterally so that pins 56 extend through feed holes in the form, levers 53 are operated to clamp the tractors in place, and the top plates are closed on top of the form.

In FIG. 2, the push/pull/park selector lever 26 has a downwardly descending arm 26A mounted for movement about a pivot axis 28. A pivot screw 28A secures arm 26A to a bearing 29 which in turn is supported by a right frame side plate 32. The side plate 32 has three slots 34, two of which (34B and 34C) are visible in FIG. 2. A detent 26B, carried by the arm 26A, cooperates with slots 34 to detent the selector lever 26 at one of three positions. These positions are the pull position (illustrated in FIG. 2) the park position (detent 26B engages slot 34B) and the push position (detent 26B engages slot 34C).

A cam 36 is integrally formed with, or attached to, lever 26 and arm 26A so as to rotate about pivot axis 28 as the lever is moved. Cam 36 has two side-facing cam surfaces located one above the other. Each cam surface has two ramps 38A and 38B and a flat surface 38C. A cam follower 40 is rotatably mounted on one end of the tractor drive shaft 42. The surfaces of cam 36 exert a force against the side surface of cam follower 40 as lever 26 is rotated clockwise from the position shown in FIG. 2. This pulls the tractor drive shaft 42 rightwardly along its own axis against the force of a compression spring 44.

As seen in FIG. 2 and 4, the tractor drive shaft 42 has a square central portion but is rounded at a left end portion 42A and a right end portion 42B. The shaft 42 is supported for free rotational and axial movement in the right side frame 32 and a left side frame 46 (FIG. 4).

The compression spring 44 exerts a force between the end of the squared portion of drive shaft 42 and the side of the support bearing 48A of right tractor plate 48. The support bearing 48A is mounted on shaft 42 so that it may slide relative thereto but the support bearing is prevented from moving to the right by the side plate 32. Therefore, the force of the compression spring 44 moves drive shaft 42 to the left thereby keeping the cam follower 40 in contact with the camming surfaces of cam 36. A retainer ring 50 prevents the compression spring 44 from slipping over the corners at the end of the squared portion of shaft 42.

Figure 6A:
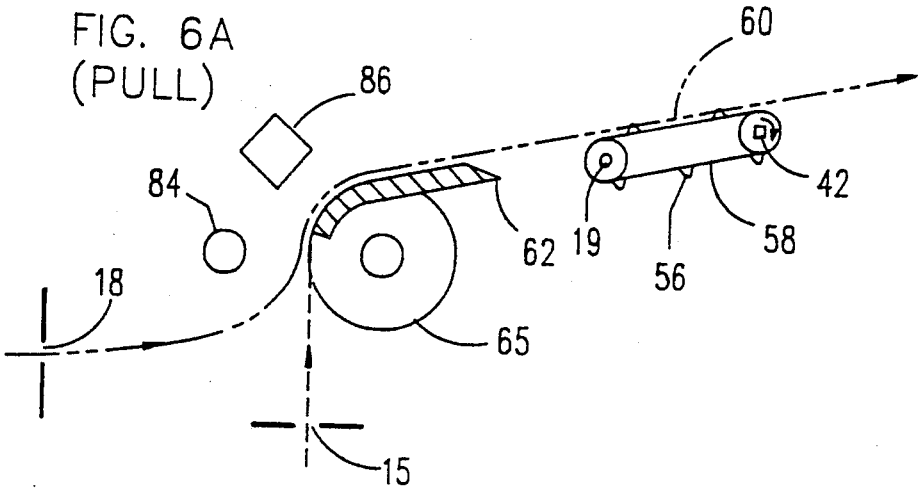

When the selector lever 26 is in the position shown in FIG. 2, the axial position of drive shaft 42 is such that a drive gear 52, fixed to the shaft at the left end thereof (see FIG. 4) engages a first gear 54. This position of selector lever 26 is defined as the "pull" position since, as subsequently explained, gear 54 drives shaft 42 in a direction such that the tractors 16 and 17 pull continuous forms away from the printing platen. This is illustrated in FIG. 6A where the tractor drive shaft 42 is driven clockwise so that pins 56 (FIG. 4) on the drive belt 58 pull continuous forms 60 away from a platen 62.

When selector lever 26 is rotated clockwise about pivot screw 28 toward the rear of the printer, the cam follower 40 rides up the surfaces 38A of cam 36 thereby drawing the tractor drive shaft 42 to the right. When the detent 26B detents in the middle detent slot 34B, the position of shaft 42 is such that the gear 52 on the left end thereof is not engaged with any drive gear. This position of selector lever 26 is defined as the park position because the continuous form feed tractors 16 and 17 are not driven.

As the selector lever 26 is rotated clockwise from the park position, the cam follower 40 rides up the cam surfaces 38B thus drawing the drive shaft 42 further to the right. When detent 26B enters the rear-most detent slot 34C the selector is in the push position. At this time the drive gear 52 on the drive shaft 42 engages a second gear 82 so that shaft 42 is driven in a direction which causes the tractor pins to push the continuous form 60 toward the platen 62.

The tractor drive shaft is driven by a drive arrangement including a stepper motor 64 (FIG. 4) and a plurality of gears. Since the drive arrangement is of conventional design, it is drawn to show the complete drive path rather than the actual relative positions of the stepper motor and gears. A gear 66 is mounted on the output shaft of stepper motor 64. Gear 66 drives a compound gear 68/70 which in turn drives a gear 72. Gear 72 drives pressure rolls (not shown in FIG. 4) which feed the paper to the platen. Gear 72 also drives a compound gear 74/76/76A. The gear 76/76A drives a pull gear 54 and a push idler gear 80 which in turn drives another push idler gear 82. The arrangement is such that when gear 52 engages gear 54 the tractor shaft 42 is rotated in a direction which rotates the upper lengths of pin feed belts 58 away from platen 62. Gear 82 rotates in the opposite direction from gear 54 hence when shaft 42 is shifted to the right to engage gear 82, the shaft 42 is driven in a direction which rotates the upper lengths pin of feed belts 58 toward the platen 62. When selector lever is in the park or middle position, the shaft 42 is shifted to the right as viewed in FIG. 4 so that drive gear 52 is opposite the space between gears 54 and 82 and the shaft 42 is not driven in either direction.

The mode selector lever 26 (FIG. 2), in addition to causing a shifting of the tractor drive shaft 42 axially, also causes a rotation of the feed tractors 16 and 17 about the shaft. In FIGS. 2 and 5, a bell crank 30 is mounted for rotation about pivot axis 28 and is keyed to the downwardly descending arm 26A of lever 26 so that the bell crank rotates as the lever 26 is moved. The bell crank has an arm 30A with a pin 96 projecting from one side thereof. Pin 96 extends into an elongated slot 98 in the tractor plate 48 so that rotation of the tractor plate 48, tractor guide rod 19 and tractors 16 and 17 is limited by the pin 96.

FIG. 6A shows the orientation of the tractors 16 and 17 relative to platen 62 when the selector lever 26 is in the pull position illustrated in FIG. 2. The plane of the upper portion of belt 58 is toward platen 62 near its uppermost point. The continuous form 60 is introduced through front slot 18 or bottom slot 15 and passes between the feed rolls 65 and pinch rolls 84, then between the print head 86 and platen 62 from whence it is pulled by the pins 56 of the tractors. The left tractor plate 47 has a pad 47B (FIG. 3) which acts through a conventional linkage (not shown) to hold spring-loaded pinch rolls 84 away from feed rolls 65 when operating in the pull mode. This frees the continuous form 60 so that it may be pulled by pins 56.

Figure 6B:
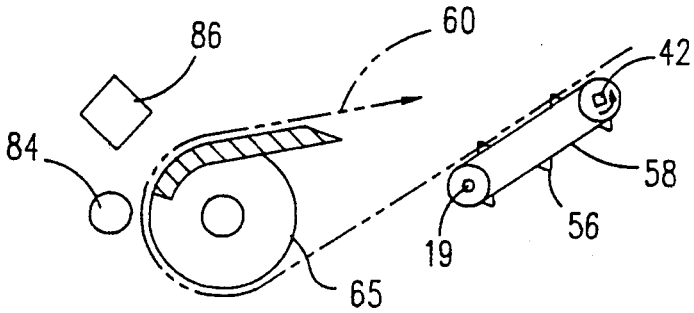

The printer operates in the push mode to feed a continuous form 60 from a stack at the rear of the printer along a path as illustrated in FIG. 6B. The operator selects the push mode by moving the mode selector lever to the push position where detent 26B is detented in slot 34C.

As the mode selector lever 26 is moved from the pull or the park position to the push position, the crank arm 30A moves downwardly and rearwardly so that the front end of the tractor assembly T is tilted downwardly by the pin 96 acting against the slot in tractor plate 48. As the tractor assembly tilts downwardly, the pad 47B moves away to permit the spring-loaded pinch rollers 84 to press the paper against feed rolls 65 if they are not already pressing against the feed rolls. In this regard, the pad 47B actually reaches a position where the pinch rollers apply pressure to the paper when the selector lever 26 is between the push and park positions. When the selector detent 26B is detented in slot 34C, the tractors 16 and 17 are tilted as shown in FIG. 6B. Continuous form 60 is pushed by the tractors along a path toward the bottom surface of the feed rolls 65. The form passes between the feed rolls 65 and pinch rolls 84 (now closed), and between the platen 62 and print head 86 before exiting from the printer.

Figure 6C:
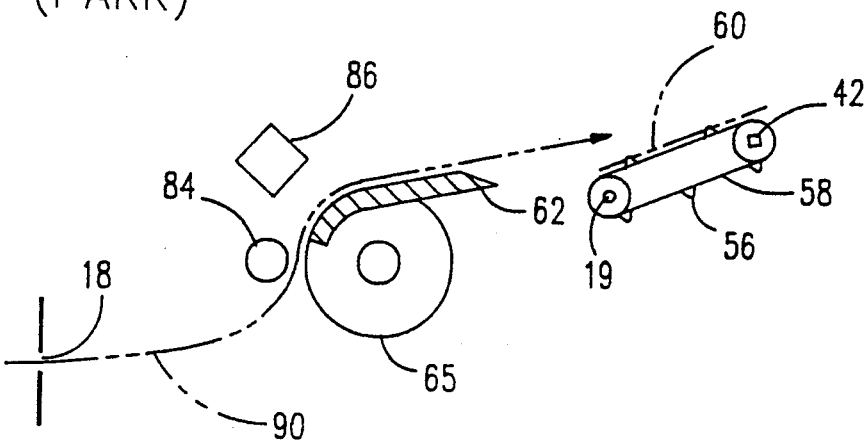

When the printer is in the pull or the push mode it may be changed to the park mode by operating a "park" switch on control panel 22 and then setting selector lever 26 to the park position. In the park mode the tractors 16 and 17 are not driven, as previously described, and single sheets of paper 90 are fed into the printer through front slot 18 and along a path as illustrated in FIG. 6C.

When the park switch is operated, the drive stepper motor 64 is energized in the reverse direction to back the leading end of the continuous form out of the path over which single sheets are fed. If the printer has been operating in the push mode, the stepper motor reverse feeds the continuous form over the path shown in FIG. 6B and parks it on the tractors. When the selector lever 26 is subsequently moved to the park position to tilt the tractors, the position of the parked continuous form is as illustrated in FIG. 6C.

If the printer has been operating in the pull mode, operation of the park switch on control panel 22 causes the continuous form 60 to be fed in the reverse direction along one of the paths illustrated in FIG. 6A. Since the pinch rollers 84 are open, the form is free to fall under its own weight once it has been reverse fed so as to be free of the tractor feed pins 56.

After the park switch has been operated to clear the continuous form from the single sheet feed path, the selector lever 26 is moved to the park position where detent 26B detents in slot 34B. The pin 96, acting in slot 98 raises or lowers the front end of the tractor feed assembly T so that it is oriented as shown in FIG. 6C with the plane of feed belts 58 extending directly toward feed rolls 65. If the selector lever 26 is moved from the push position to the park position, the raising of the front end of the tractor assembly T does not cause enough movement of pad 47B to move pinch rolls 84 out of contact with feed rolls 65. On the other hand, movement of selector lever 26 from the pull position to the park position causes pad 47B to move away and allow the pinch rolls 84 to press against the feed rolls 65.

From the foregoing description it is seen that the present invention provides a mechanism, responsive to positioning of a single mode selection lever, for axially shifting a tractor drive shaft relative to a drive source so as to select the direction of rotation of the tractor feed pins, the mechanism at the same time controlling the orientation of the tractors relative to the platen, whereby a push, pull or park mode of operation may be selected. While a preferred embodiment of the invention has been described in specific detail, it will be understood that various modifications and substitutions may be made in the described embodiment without departing from the spirit and scope of the invention as defined by the appended claims.

We claim:

1. In a printer, a form feed tractor device of the type having a pair of tractors mounted on a drive shaft having a drive gear affixed thereto which is selectively engageable with a first or second drive means to drive said tractors in a first or a second direction, said tractor device being characterized in that:

said tractors are slidably and pivotally mounted on said drive shaft; and, selector means having a single selector lever are provided for tilting said tractors about said drive shaft and shifting said drive shaft axially to selectively engage said first or said second drive means.

2. A form feed tractor device as claimed in claim 1 wherein said selector means includes a cam integral with said selector lever, a cam follower mounted on said drive shaft, and spring means for biasing said drive shaft in an axial direction to cause said cam follower to engage said cam.

3. A form feed tractor device as claimed in claim 2 wherein said selector lever is provided with a detect for detenting said selector lever at a push position whereat said drive gear engages said first drive means, a pull position whereat said drive gear engages said second drive means, and a part position whereat said drive gear is not driven.

4. A form feed tractor device as claimed in claim 1 wherein said selector means comprises a crank arm keyed to pivot with said single selector lever, a tractor guide rod supporting said tractors, and a tractor plate pivotally mounted on said drive shaft, said tractor plate being responsive to pivoting movement of said crank arm to pivot said guide rod about said drive shaft.

5. A form feed tractor device as claimed in claim 4 wherein said tractor plate has an elongated slot therein and said crank arm has a pin extending laterally of said crank arm and into said slot.

6. A form feed tractor device operable in a push mode to push a continuous form toward one side of a printing platen, a pull mode to pull a continuous form away from a second side of the printing platen, or a park mode in which the continuous form is parked so that sheets may be fed to the printing platen, said device comprising:

an axially shiftable tractor drive shaft having a drive gear affixed thereto;

first and second drive means selectively engageable o with said drive gear to rotate said drive shaft in a first or a second direction;

first and second tractors having first ends slidably and pivotally mounted on said drive shaft and second ends extending toward said printing platen;

a mode selector lever;

first means responsive to said mode selector lever for axially shifting said drive shaft whereby said drive gear selectively engages either said first or second drive means or neither said first or second drive means; and, second means responsive to said mode selector lever for pivoting said second ends of said tractors about said drive shaft to orient said tractors relative to said printing platen.

7. A form feed tractor device as claimed in claim 6 wherein said first means comprises a cam means.

8. A form feed tractor device as claimed in claim 7 wherein said cam means comprises a cam movable with said mode selector lever and a cam follower mounted on said drive shaft, and a spring for axially biasing said drive shaft whereby said cam follower is biased against said cam.

9. A form feed tractor device as claimed in claim 6 wherein detent means are provided for detenting said mode selector lever at a push, pull or park position, said second means orienting said tractors toward said first side of said printing platen and said first means shifting said drive shaft so that said drive gear engages said first drive means when said mode selector lever is in said push position, said second means orienting said tractors toward said second side of said printing platen and said first means shifting said drive shaft so that said drive gear engages said second drive means when said mode selection lever is in said pull position.

10. A form feed tractor device as claimed in claim 9 in combination with a printer having feed rolls and pinch rolls for pressing a sheet against said feed rolls, said pinch rolls being movable away from said feed rolls in response to said second means as said mode selector is moved to said pull position.

11. A form feed tractor device as claimed in claim 6 wherein said second means comprises:

first and second tractor plates pivotally mounted at a first end on said drive shaft and having second ends attached to a guide rod, the second ends of said tractors being slidably supported on said guide rod; and, crank means responsive to movement of said selector lever for applying a force to one of said tractor plates to thereby pivot said second ends of said tractors about said drive shaft.

12. A form feed tractor as claimed in claim 11 and including a pivot means about which said mode selector lever may move, said crank means comprising a bell crank mounted on said pivot means for movement with said mode selector lever and having an arm against which said one of said tractor plates bears.

13. A form feed tractor device as claimed in claim 12 wherein said cam comprises two side-facing cam surfaces.

14. A form feed tractor device as claimed in claim 11 wherein said first means comprises a cam moved by said mode selector lever, a cam follower on said drive shaft and spring means for biasing said cam follower against said cam.

15. A form feed tractor device of the type having a pair of tractors slidably mounted on a drive shaft having a drive gear affixed thereto which is selectively engageable with a first or a second drive means to drive said tractors in a first or a second direction, said tractor device being characterized in that it includes a mode selection lever, first means responsive to movement of said mode selection lever for tilting the tractors about the drive shaft and second means responsive to movement of said mode selection lever for shifting the drive shaft axially to selectively engage the first or the second drive means.

16. A form feed tractor device as claimed in claim 15 wherein said first and second means comprise means for concurrently tilting the tractors and shifting the drive shaft.

17. A form feed tractor device as claimed in claim 15 wherein said mode selection lever is mounted for pivoting movement and said first means comprises a crank arm keyed to pivot with said mode selection lever, a tractor guide rod supporting said tractors, and a tractor plate pivotally mounted on said drive shaft, said tractor plate being responsive to pivoting movement of said crank arm to pivot said tractor guide rod about said drive shaft.

18. A form feed tractor device as claimed in claim 17 wherein said tractor plate has an elongated slot therein and said crank arm has a pin extending laterally of said crank arm and into said slot.

* * * * *